US008970364B2

(12) United States Patent
Watts

(10) Patent No.: US 8,970,364 B2
(45) Date of Patent: Mar. 3, 2015

(54) METHOD AND SYSTEM FOR REMOTE COUPLING SECURITY SYSTEM CONTROL

(71) Applicant: Numerex Corp., Atlanta, GA (US)

(72) Inventor: Wesley Watts, Dallas, GA (US)

(73) Assignee: Numerex Corp., Atlanta, GA (US)

( * ) Notice: Subject to any disclaimer, the term of this patent is extended or adjusted under 35 U.S.C. 154(b) by 91 days.

(21) Appl. No.: 13/644,001

(22) Filed: Oct. 3, 2012

(65) Prior Publication Data

US 2013/0082836 A1 Apr. 4, 2013

Related U.S. Application Data

(60) Provisional application No. 61/542,518, filed on Oct. 3, 2011.

(51) Int. Cl.
*G08B 1/08* (2006.01)
*G08B 25/08* (2006.01)
*G08B 25/14* (2006.01)

(52) U.S. Cl.
CPC ..... *G08B 25/08* (2013.01); *G08B 25/14* (2013.01)
USPC ..... 340/539.1; 340/539.14; 340/539.16

(58) Field of Classification Search
CPC ..... G08B 25/009; G08B 25/06
See application file for complete search history.

(56) References Cited

U.S. PATENT DOCUMENTS

| | | | | |
|---|---|---|---|---|
| 3,482,037 | A | 12/1969 | Brown et al. | |
| 5,625,338 | A | 4/1997 | Pildner et al. | |
| 7,135,959 | B2 * | 11/2006 | Wagner et al. | 340/286.11 |
| 7,855,635 | B2 | 12/2010 | Cohn et al. | |
| 2006/0012466 | A1 * | 1/2006 | Wagner et al. | 340/286.11 |
| 2007/0279247 | A1 | 12/2007 | Rye et al. | |
| 2008/0224851 | A1 * | 9/2008 | Pumpelly et al. | 340/538 |
| 2008/0311879 | A1 | 12/2008 | Martin et al. | |
| 2009/0079705 | A1 | 3/2009 | Sizelove et al. | |
| 2009/0295571 | A1 | 12/2009 | Hosey | |
| 2010/0097210 | A1 * | 4/2010 | Tyroler et al. | 340/540 |

FOREIGN PATENT DOCUMENTS

WO 2010/019624 A1 2/2010

* cited by examiner

*Primary Examiner* — Travis Hunnings
(74) *Attorney, Agent, or Firm* — Bellnunnally & Martin LLP; Craig J. Cox

(57) ABSTRACT

An adaptor for remote coupling a security system to a monitoring center is described. The adaptor includes both a wireless connection to an alarm panel and a remote wireless interface. The wireless connection to the alarm panel is configured such that the adaptor appears to the alarm panel as a control pad. The adaptor communicates with a central station using the remote wireless interface and is operable to translate messages between the alarm panel and the central station into an appropriate protocol.

16 Claims, 3 Drawing Sheets

METHOD AND SYSTEM FOR REMOTE COUPLING SECURITY SYSTEM CONTROL

CROSS REFERENCE TO RELATED INFORMATION

This application claims the benefit of U.S. Provisional Patent Application No. 61/542,518, filed Oct. 3, 2011, the contents of which are hereby incorporated herein in their entirety.

TECHNICAL FIELD

The present invention relates generally to the field of security alarm systems, and more particularly relates to coupling a legacy alarm system to it remote server within external network via two-way data communications between the remote server and the legacy alarm system.

BACKGROUND OF THE INVENTION

Security alarm systems comprise component parts designed to detect, determine and alert for unauthorized entry, activity, or other events. A security alarm system can detect events like motion, smoke or sound and then send a notification about the event, usually to a remote, centralized monitoring, center, commonly referred to as a "central station" who will then notify responsible police or fire departments. The security alarm system components that detect activity are sensors that include door and window disturbance contacts, motion sensors, glass break detectors and panic buttons.

Sensors of legacy systems are often connected to the premises' security alarm system controller, most often referred to as an "alarm panel", through wires although, starting in 1966 with U.S. Pat. No. 3,482,037 sensors were, in some installations, connected to the alarm panel with short range radio—"wireless". In addition to sensors, a security system will typically include a keypad to enable an operator to control the security alarm system. The keypad typically installed near an entrance or exit of the monitored premise to facilitate the operator's ability to arm and disarm the system quickly upon entering the premises.

By using a numerical code the operator can arm or activate the system as well as examine information about an event. Most modem keypads have an illuminated display that displays the status of the security alarm system with alphanumeric text. When a reportable event is detected by a security alarm system it typically perform two primary actions in response to the event. The security alarm system can communicate to a remote central station monitoring center, and it can optionally activate alarm annunciators located at or near the monitored premises. Most legacy security alarm systems communicate events to a remote alarm central station monitoring center with tones via a dial-up wire-line telephone connection using the Public Switched Telephone Network (PSTN).

Some of the more modern prior-art security alarm systems communicate events to a remote alarm central station monitoring center with data messages via network connections, including the Internet or private network. In some cases, these network connections are conveyed by prior-art over commercial wireless data transport connections, such as cellular based, including such systems that utilize the GSM, CDMA, UMTS and LTE standards, using a dialer or communications port designed for that purpose. The dialer port being designed for the conveyance of alarm data has very little, if any, control capability.

Typical security alarm systems incorporate a keypad, as mentioned above, with connection to the premises' security alarm panel, via wires utilizing a serial data protocol that is, usually, proprietary the specific brand of security alarm system controller. An exemplary application would be the Ademco keypad model 6139. Some more modern legacy systems use keypads that connect to the alarm panel via a short range wireless connection instead of using a wired serial bus. An example of such is U.S. Pat. No. 5,625,338 that teaches a two-way wireless keypad that uses short range radio between the keypad and the alarm panel. Patent '338 simply teaches elimination of local premise wiring and fails to teach remote wireless communication of the keypad.

It is advantageous to in able the remote alarm central station monitoring center, either directly or through an intermediate server, to be able to effect more control on to legacy security alarm system through a cost effective adjunct retrofit capability. U.S. Pat. No. 7,855,635 teaches one method of enabling a remote server to effect more control on as legacy security alarm system by connecting a remote server to a legacy alarm security system by interfacing a communications processor to the serial bus designed for interconnecting a premise alarm system's alarm panel to a co-located keypad, analyzing the serial digital protocol signals to attempt to determine the type of serial digital protocol being used and then interpreting the commands to be suitable for use for communication to a remote server over selected wired or wireless public telecommunications networks. Unfortunately the method of '635 fails in that it is expensive to install due to labor costs associated with hardwire connections and failure prone and may encounter slow connections, due to the complexity of hardwire connections, as well as the complexity associated with interpretations of proprietary communication protocols. It is a goal of this invention to resolve these and other problems.

BRIEF SUMMARY OF THE INVENTION

In a preferred embodiment, a system for remote coupling a security system to a monitoring center is described. The system includes an alarm and connected to one or more alarm sensors and to one or more control pads, and an adaptor connected to the alarm panel such that the adaptor appears to the alarm panel as a control pad. The adaptor includes a remote communications interlace used to communicate with as central station and is operable to translate messages between the alarm panel and the central station into an appropriate protocol.

In another preferred embodiment, an adaptor for remote coupling a security system to a monitoring center is described. The adaptor includes a wireless connection to an alarm panel, the wireless connection configured such that the adaptor appears to the alarm panel as a control pad, and a remote wireless interface to communicate with a central station. The adaptor is operable to translate messages between the alarm panel and the central station into an appropriate protocol.

In yet another embodiment, a system for remote coupling a security system to a monitoring center is described that includes an alarm panel housing the control electronics for the security system, one or more alarm sensors monitoring conditions for the security system, and one or more control pads providing a user interface between the alarm panel and a user. An adaptor is connected to the alarm panel using a first wireless interface such that the adaptor appears to the alarm panel as a control pad. The adaptor also includes a second wireless interface for remote communications. The adaptor communicates with a central station using the second wireless interface and is operable to translate messages between the alarm panel and the central station into an appropriate protocol.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The present invention enables an alarm central station monitoring center, either directly or through an intermediate server, to be able to effect more control on a legacy security alarm system through a cost effective adjunct retrofit capability that utilizes standard interfaces and does not rely upon the interpretation of proprietary communication protocols.

Figure 1:
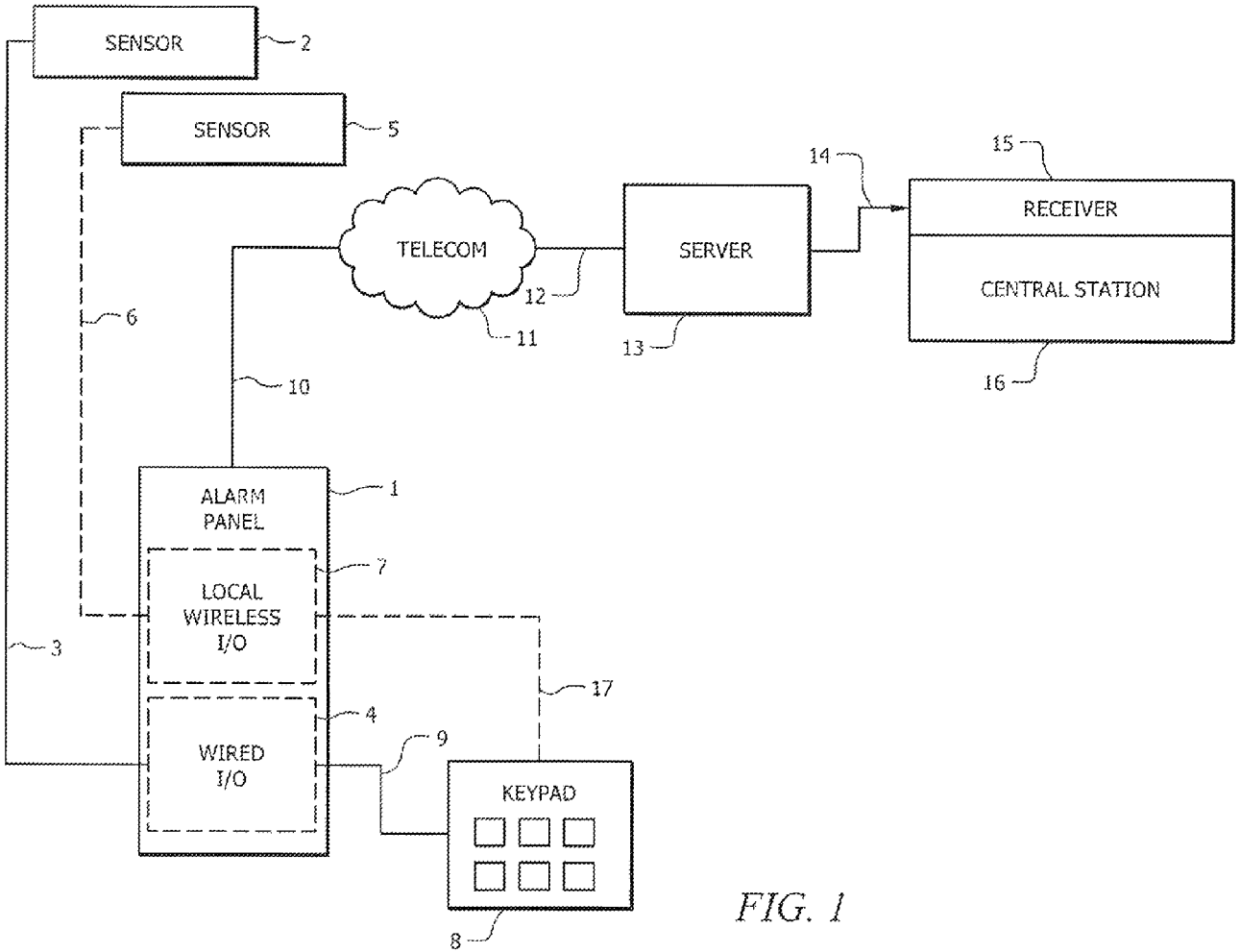
FIG. 1 is a block diagram of a prior art alarm system.

FIG. 1 illustrates a typical legacy security alarm system as currently practiced. The premises' security alarm system controller (referred to as the "alarm panel") 1 possesses two interfaces for interlacing sensors 2, 5 and keypad(s) 8. Sensor 2 is connected via wire 3 to the wired sensor input/out port 4 of alarm panel 1. Sensor 5 is connected via short range radio signal 6 to the wireless sensor input/out port 7 of alarm panel 1. When an event triggers sensor 2 it alters electrical connectivity through wires 3 to the wired sensor input/out port 4 of alarm panel 1 so as to stimulate a report of the event. Similarly, when an event triggers sensor 5 it transmits a data packet short-range radio signal 6 to the wireless sensor input/out port 7 of alarm panel 1 so as to store a report of the event.

Keypad 8 enables a user at or near the premise to enter a predetermined code that, if correct, causes keypad 8 to send a signal over the two-way wired keypad bus 9 to alarm panel 1 via the wired sensor input/out port 4 to instruct alarm panel 1 of the user's response to that particular event signal, such as canceling or ignoring an event. Alternatively, in some installations keypad 8 interfaces with alarm panel 1 with a short range radio signal 17 via local wireless I/O 7 with functionality being the same as described above.

Alarm panel 1, upon receipt of an event detected by a sensor 2 and/or 5, transmits an alarm signal to server 13 via public telecommunications channel 10 hosted by telecommunications service provider 11, which can be a wired telephone line but, in some cases, will be wireless telecommunications using cellular telephony, Short Message Service (SMS) or TCP/IP over either public cellular telecommunications data channels, such as GPRS or LTE, or wired networks, such as ADSL or even VOIP. The communications path 12 from telecommunications service provider 11 to server 13 can be any type of connection, but is most often a dial-up or dedicated wireline telephone circuit provided by telecommunications service provider 11. It may also be wireless telecommunications using cellular telephony, Short Message Service (SMS) or TCP/IP over either public cellular telecommunications data channels, such as GPRS or LTE, or wired networks, such as ADSL or even VOIP. Once the event is received by server 13 the identity of alarm panel 1 is used to query a database of server 13 to determine which central station 16 is to receive the event report and what communications path and protocol should be used. After making this determination, server 13 transmits the event data to alarm receiver 15, which is a part of central station 16, via communications circuit 14.

When central station 16 receives the reported event data it takes action based upon predetermined criteria which may include alerting police or fire departments, as appropriate to the type of event. In addition to the above described transmission of event data from alarm panel 1 to server 13 and ultimately central station 16, alarm panel 1 also sends a version of the same event data to keypad 8, in most cases simultaneously but in some cases prior to sending it to server 13 and ultimately central station 16 so as to provide a user at the premise to cancel the event transmissions, such as when the user enters the premise via a door identified in the database of alarm panel 1 as a delayed action sensor.

Figure 2:
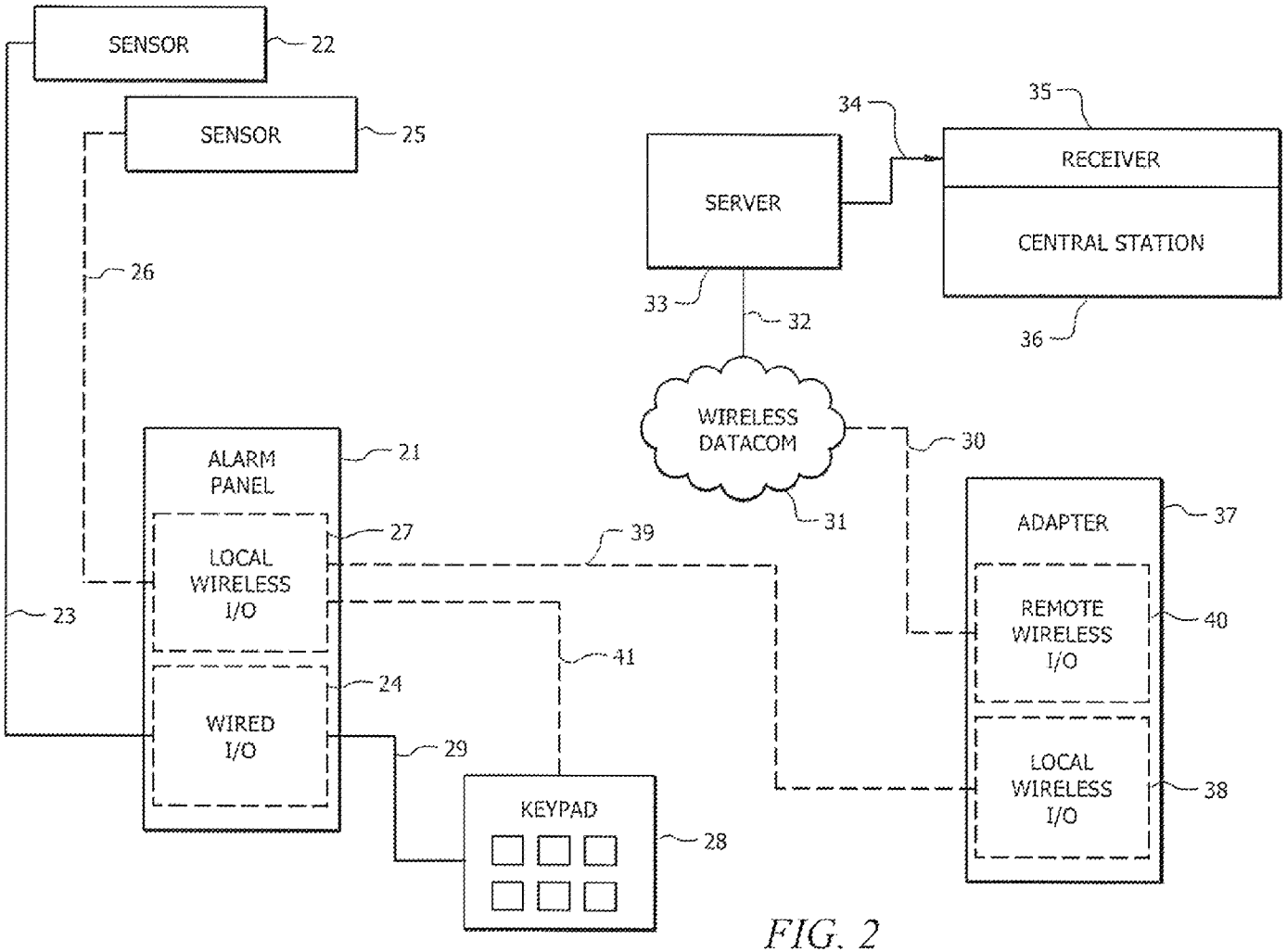
FIG. 2 is a block diagram of a preferred embodiment of an alarm system according to the concepts described herein.
Figure 3:
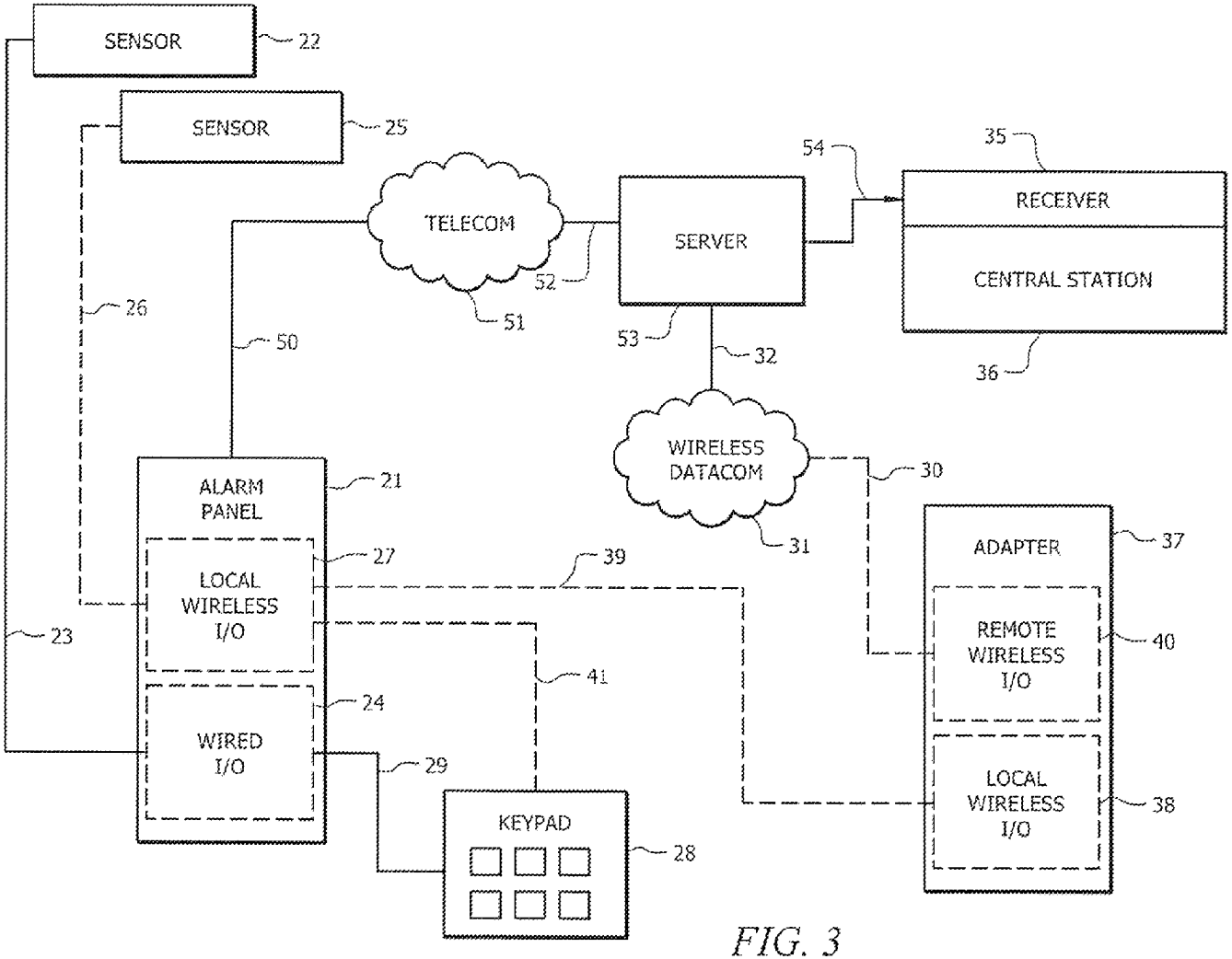
FIG. 3 is a block diagram of an alternate embodiment of an alarm system according to the concepts described herein.

Referring now to FIG. 2 and FIG. 3, a preferred embodiment of the invention according to the concepts described herein is described, including the sequence and method of interaction therein. The premises' security alarm system controller (alarm panel) 21 possesses two interfaces for interfacing sensors 22, 25 and keypad(s) 28. Sensor 22 is connected via wire 23 to the wired sensor input/out port 24 of alarm panel 21. Sensor 25 is connected via short-range radio signal 26 to the wireless sensor input/out port 27 of alarm panel 21. When an event triggers sensor 22 it alters electrical connectivity through wires 23 to the wired sensor input/out port 24 of alarm panel 21 so as to stimulate a report the event.

Similarly, when an event triggers sensor 23 it transmits a data packet short-range radio signal 26 to the wireless sensor input/out port 27 of alarm panel 21 so as to stimulate a report of the event. Keypad 28 enables a user at or near the premise to enter a predetermined code that, if correct, causes keypad 28 to send a signal either over the two-way wired keypad bus 29 to alarm panel 21 via the wired sensor input/out port 24 to instruct alarm panel 21 of the user's response to the event signals, such as canceling or ignoring an event. Alternatively, in some installations keypad 28 interfaces with alarm panel 21 with a short range radio signal 24 via local wireless I/O 27 with functionality being the same as described above.

Alarm panel 21, upon receipt of an event detected by a sensor 22 and/or 25, transmits event data to keypad 28 via the two-way wired keypad bus 29 or short range radio signal 41, depending upon the configuration. A user at the premise may, optionally, cancel or alter the event transmissions, such as when the user enters the premise via a door identified in the database of alarm panel 21 as a delayed action sensor. Simultaneous with alarm panel 21 sending event data to keypad 28, as described above, alarm panel 21 also transmits the event data over short range radio signal 39 to adapter 37 via the local wireless I/O 38 of adapter 37. Adapter 37 is designed to appear to local wireless I/O 27 of alarm panel 21 as an additional two-Way keypad but in reality firmware within adapter 37 translates event data from alarm panel 21 and keypad messages to alarm panel 21 to and from an internal messaging queue.

Adapter 37 in reaction to receipt of messages from alarm panel 21 via short range radio signal 39 translates such messages to/from protocols understood by server 33 and then sends the event data to server 33 over wireless telecommunications channel 30 and wireless data-communications service provider 31, which may be any combination of cellular radio-telephone data, Short Message Service (SMS) Or TCP/IP over either public cellular telecommunications data channels, as GPRS or LTE. The communications link 32 from wireless data-communications service provider 31 to server 33 may be dial-up or dedicated wireline telephone circuit but may also be wireless telecommunications using cellular telephony, Short Message Service (SMS) or TCP/IP over either public cellular telecommunications data channels, such as GPRS or LTE, or wired networks, such as ADSL or even VOIP. Similar to the process described for FIG. 1, once the event is received by server 33 the identity of alarm panel 21 is used to query a database of server 33 to determine which central station 36 is to receive the event report and what communications path and protocol should be used. After making this determination, server 33 transmits the event data to alarm receiver 35, which is a part of central station 36, via communications circuit 34, which is typically a dial-up telephone line but may also be wireless telecommunications using cellular telephony, Short Message Service (SMS) or TCP/IP over either public cellular telecommunications data channels, such as GPRS or LTE, or wired networks, such as ADSL or even VOIP.

When central station 36 receives the reported event data it takes action based upon predetermined criteria which may include alerting police or fire departments, as appropriate to the type of event. In addition to the above described transmission of event data from alarm panel 21 to server 33 and ultimately central station 36. Messages that can be transmitted from alarm panel 21 to server 33 include but are not limited to alarm events, non-alarm sensor events, system status changes, replies to commands, aim and disarm events, test signals. Messages that can be transmitted from server 33 to alarm panel 21 include but are not limited to status request, success/failure of event delivery, arm and disarm commands, automation commands (dim lights, change thermostat temperature, lock door) and test signals.

FIG. 3 illustrates another embodiment of the invention where the functionality of FIGS. 1 and 2 are combined such that there is a choice of paths for delivery of event data to server 53, either via telecommunications provider 51 using communications paths 50, 52 or wireless data-communications provider 22. Thereafter, the communications are sent to central station 36 over communications path 54, as is described above.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for remote coupling a security system to a monitoring center, the system comprising:

an alarm panel connected to one or more alarm sensors and to one or more control pads, one or more of the sensors or control pads connected to the alarm panel using a local wireless interface; and an adaptor connected to the alarm panel using the local wireless interface such that the adaptor appears to the alarm panel as a control pad, the adaptor including a remote communications interface;

wherein the adaptor communicates with a central station using the remote communications interface and is operable to translate protocol messages between the alarm panel and the central station into an appropriate protocol.

2. The system of claim 1 wherein the adaptor is the only communications path between the central station and the alarm panel.

3. The system of claim 1 wherein the alarm panel can communicate with the central station using the adaptor and a conventional telecom interface.

4. The system of claim 1 wherein the remote communications interface is a wireless interface.

5. The system of claim 1 wherein the adaptor is connected to the alarm panel by a wireless interface.

6. The system of claim 1 wherein the central station is operable to send messages to the alarm panel using the adaptor.

7. An adaptor for remote coupling a security system to a monitoring center, the adaptor comprising:

a wireless connection to an alarm panel using a local wireless interface of the alarm panel, the local wireless interface used to connect the alarm panel to wireless sensors and wireless keypads, the wireless connection configured such that the adaptor appears to the alarm panel as a control pad; and a remote wireless interface, wherein the adaptor communicates with a central station using the remote wireless interface and is operable to translate protocol messages between the alarm panel and the central station into an appropriate protocol.

8. The system of claim 7 wherein the adaptor is the only communications path between the central station and the alarm panel.

9. The system of claim 7 wherein the alarm panel can communicate with the central station using the adaptor and a conventional telecom interface.

10. The system of claim 7 wherein the remote communications interface is a wireless interface.

11. The system of claim 7 wherein the adaptor is connected to the alarm panel by a wireless interface.

12. The system of claim 7 wherein the central station is operable to send messages to the alarm panel using the adaptor.

13. A system for remote coupling a security system to a monitoring center, the system comprising:

an alarm panel housing the control electronics for the security system;

one or more alarm sensors in communication with the alarm panel and monitoring conditions for the security system;

one or more control pads providing a user interface between the alarm panel and a user, wherein one or more of the sensors or control pads is connected to the alarm panel using a local wireless interface; and an adaptor connected to the alarm panel using the local wireless interface such that the adaptor appears to the alarm panel as a control pad, the adaptor including a second wireless interface for remote communications;

wherein the adaptor communicates with a central station using the second wireless interface and is operable to translate protocol messages between the alarm panel and the central station into an appropriate protocol.

14. The system of claim 13 wherein the adaptor is the only communications path between the central station and the alarm panel.

15. The system of claim 13 wherein the alarm panel can communicate with the central station using the adaptor and a conventional telecom interface.

16. The system of claim 13 wherein the central station is operable to send messages to the alarm panel using the adaptor.

* * * * *